US006327447B1

(12) United States Patent
Nakano et al.

(10) Patent No.: US 6,327,447 B1
(45) Date of Patent: Dec. 4, 2001

(54) ELECTROPHOTOGRAPHIC APPARATUS HAVING HEAT EXHAUSTION DEVICE

(75) Inventors: Masaru Nakano, Tsukuba; Kenji Mori, Tsuchiura; Katsumasa Mikami, Naka; Kazuhiro Wakamatsu, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/665,321

(22) Filed: Sep. 19, 2000

(30) Foreign Application Priority Data

Aug. 21, 2000 (JP) ..... 12-254255

(51) Int. Cl.[7] ..... G03G 15/00
(52) U.S. Cl. ..... 399/92; 399/94
(58) Field of Search ..... 399/92, 94, 97, 399/93

(56) References Cited

U.S. PATENT DOCUMENTS 4,202,618 * 5/1980 Waschk et al. ..... 399/93
5,023,654 * 6/1991 Matsumoto et al. ..... 399/93
5,047,798 * 9/1991 Yamamoto et al. ..... 399/93
5,164,778 * 11/1992 Tanabe et al. ..... 399/93 X
5,189,473 * 2/1993 Negoro et al. ..... 399/93

* cited by examiner

*Primary Examiner*—Quana M. Grainger
(74) *Attorney, Agent, or Firm*—Antonelli, Terry, Stout & Kraus, LLP

(57) ABSTRACT

An electrophotographic apparatus comprising: a housing; a photosensitive member electrified by an electrification device; an exposure device for forming an electrostatic latent image onto the photosensitive member; a developing device for forming a toner image onto the photosensitive member; an intermediate transfer body to which the toner image is to be transferred; a transfer device for transferring the toner image formed on the intermediate transfer body onto a paper; a fixing device for heating the toner image on the paper; device for ejecting the paper outside the housing; device for exhausting the heat derived from the fixing device outside the housing; a cover provided on an upper portion of the fixing device; and an airflow path extending in a longitudinal direction of the fixing device and being provided by the cover and the housing, wherein the heat exhausting device is provided in an end portion of the airflow path.

9 Claims, 5 Drawing Sheets

ELECTROPHOTOGRAPHIC APPARATUS HAVING HEAT EXHAUSTION DEVICE

BACKGROUND OF THE INVENTION

The present invention relates to an image recording apparatus, which performs image recording, such as an electrophotographic apparatus.

There are various types of color image recording apparatuses based on image information from computers or the like.

Among various types of systems, in particular, color image recording by an electrophotographic system forms a color image by forming yellow, magenta, cyan, and black toner images on a recording medium which is a photosensitive member, to superpose these formed toner images on a sheet of paper or on an intermediate transfer member.

This electrophotographic system is high speed and can record a color image with high image quality in comparison with an ink jet printing system or the like.

Therefore, it is expected that, in future information age, recording apparatuses in the electrophotographic system which can output images with high image quality in high speed will be increasingly required Because this color image recording equipment in the electrophotographic system must fix toner images in high speed, a large amount of heat is applied to a fixing device. As a result, warmed air stays in an upper portion of the fixing device and therefore, environmental temperature in a body of the apparatus gradually rises.

Therefore, if papers pass through an environment in such a state that toner is not completely hardened just after being taken out from the fixing device, the papers are ejected outside the apparatus with the toner being semisolid, and are stacked.

Since it is difficult for the stacked papers to radiate heat, there arises such a problem that the toner in a melted state adheres to the stacked paper. In addition, in maintenance, there is a possibility of an unexpected accident such as operator's heat burn due to the operation of removing a jam in a fixing section that is in high temperature.

Furthermore, if air heated at the fixing section due to operation in long time spreads in the apparatus and temperature in the apparatus rises nearly to a softening point of toner, there is such a possibility that toner in a developing device and waste toner which has not contribute to the image and has to be eliminated are melted.

If the waste toner melts, there is such a possibility that a problem such as filming, which toner deposits on a developing roller, and lock of a drive section such as a motor due to increase of toner transfer load arises.

Because these problems in high speed remarkably appear as apparatuses are miniaturized, in order to realize miniaturization and high speed, it is essential to lower the temperature in the apparatus by exhausting the heat staying in the apparatus.

For this purpose, it is common to provide in the body of the apparatus an exhaust fan, exhausting air, heated by the fixing device, outside the apparatus. However, if the exhaust fan is provided in a central portion of a back face of the fixing device in order to exhaust the heat staying in an upper portion of the fixing device, the airflow is only in both longitudinal ends of the fixing device since the flow of air is intercepted by a paper in such a state that the paper is sandwiched and fed by the fixing device. Hence, although temperature in the end portions of the fixing device is lowered, the apparatus is driven while high temperature in a central portion is kept.

By the way, as a conventional technology removing heat in a fixing device, JP-A-6-43788 specification (U.S. Pat. No. 5,436,709) describes such configuration that an exhaust fan is provided in one end of a fixing device in an axial direction to form airflow in the axial direction in the upper portion of the fixing roller.

However, in this conventional technology, it is described to make uniform axial temperature distribution on a surface of a fixing roller and hence to prevent the degradation of image quality. Nevertheless, it is not disclosed to exhaust the air that is heated and staying in the upper portion of the fixing device.

An object of the present invention is to provide such a small and high-speed color electrophotographic apparatus that the apparatus can stably exhaust heat, staying in an upper portion of a fixing device, outside the apparatus, can solve such a problem that ejected paper adheres to another ejected paper by semisolid toner, and has such maintainability that it is possible to safely release a jam in a fixing section.

SUMMARY OF THE INVENTION

The above object can be attained by an electrophotographic apparatus that comprises a housing; a photosensitive member electrified by electrification means; an exposure device forming an electrostatic latent image onto the photosensitive member; an intermediate transfer body to which the electrostatic latent image is to be transferred; a transfer device transferring the electrostatic latent image, formed on the intermediate transfer body, on a paper; a fixing device heating the electrostatic latent image on the paper; means for ejecting the paper outside the housing; means for exhausting the heat derived from the fixing device outside the housing; a cover provided on an upper portion of the fixing device; and an airflow path extending in a longitudinal direction of the fixing device and being provided by the cover and the housing, wherein the exhausting means is provided in an end portion of the airflow path.

In addition, the above object can be attained by an electrophotographic apparatus that comprises a housing; a photosensitive member electrified by electrification means; an exposure device forming an electrostatic latent image on the photosensitive member; an intermediate transfer body to which the electrostatic latent image is to be transferee ; a transfer device transferring the electrostatic latent image formed on the intermediate transfer body on a paper; a fixing device heating the electrostatic latent image on the paper; means for ejecting the paper outside the housing; a cover provided at an upper portion of the fixing device; an airflow path extending in a longitudinal direction of the fixing device and being provided by the cover and the housing; first air exhausting means provided in an end portion of the airflow path; and second air exhausting means provided in an upstream side, in an air flow, of the first air exhausting means.

The second air exhausting means is provided in an airflow path going to the fixing means from driving means and a drive circuit in the housing.

The second air exhausting means may be provided in an upper portion of a power supply unit in the housing.

The second air exhausting means may be provided in an upper portion of driving means and a driving circuit in the housing.

DESCRIPTION OF THE EMBODIMENTS

A general color electrophotographic apparatus will be described with reference to FIGS. 1, 2, and 3.

Figure 1:
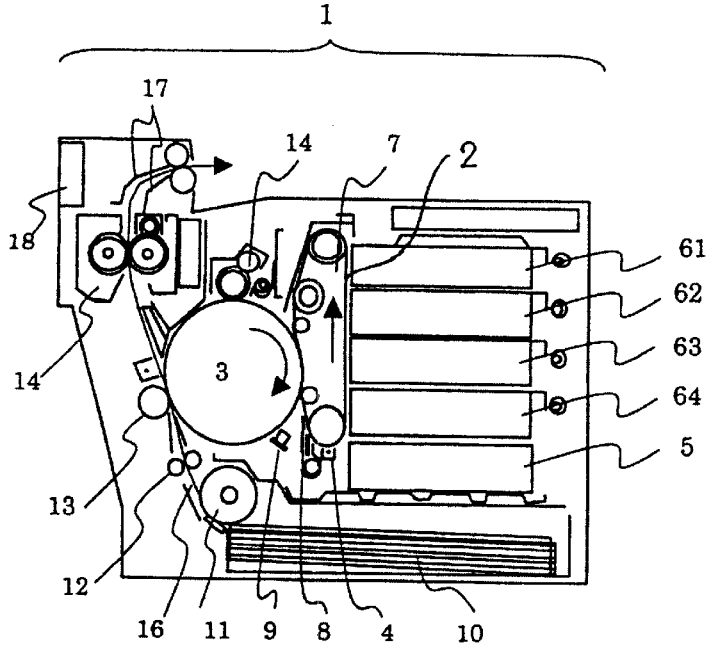
FIG. 1 PRIOR ART
FIG. 1 is a sectional side view of a general color electrophotographic apparatus.

In FIG. 1, reference numeral 1 denotes a color electrophotographic apparatus. A photosensitive belt 2 rotates in constant speed in a direction shown by an arrow. An intermediate transfer roller 3 is located in contact with the photosensitive belt 2. An electrifier 4 electrifies a surface of the photo-sensitive belt 2 uniformly. An exposure device 5 exposes the surface of the photosensitive belt 2 uniformly electrified, and forms electrostatic latent images on the surface. Four development devices 61, 62, 63, and 64 form toner images by developing the electrostatic latent images on the surface of the photosensitive belt 2. The development device 61 uses yellow toner. The development device 62 uses magenta toner. The development device 63 uses cyan toner. The development device 64 uses black toner.

A cassette 10 contains papers. A paper feeding roller 11 supplying papers from the cassette 10, and a resist roller 12 correcting an attitude of the paper supplied from the cassette 10 are provided. A transfer roller 13 transfers a toner image on the paper.

A fixing device 14 fixes the toner image transferred on the paper. Numeral 16 is the paper being conveyed. A paper eject guide 17 guides the paper 16, where the toner image is fixed by the fixing device 14, outside the apparatus.

A blade 8 removes toner remaining on the surface of the photosensitive belt 2 after transfer. An erase lamp 9 removes electric charges remaining on the surface of the photosensitive belt 2 after the transfer of the toner images. A cleaner 7 removes the toner remaining on the surface of the intermediate transfer roller 3. An exhaust fan 18 exhausts heat staying in an upper portion of the fixing device 14 outside the apparatus.

Forming procedure of a color image by the apparatus as described above will be described.

When a print signal is sent from an information-processing unit (not shown) to the apparatus 1, the exposure device 5 irradiates a laser light corresponding to a toner image in accordance with the print signal onto the surface of the photosensitive belt 2. On the surface of the photosensitive belt 2 which has been uniformly electrified by the electrifier 4, an electrostatic latent image is formed by the exposure.

First, on the photosensitive belt 2, an electrostatic latent image corresponding to a yellow toner image is formed by the exposure device 5, and is developed by the yellow development device 61 to become a toner image. A development function is given to or removed from each of the development devices 61, 62, 63, and 64 by controlling each bias voltage. The toner image formed on the photosensitive belt 2 is transferred on a surface of the intermediate transfer roller 3 in a contact section with the intermediate transfer roller 3, and is held.

On the other hand, toner not used for the transfer remains on the photosensitive belt 2 after the transfer of the toner image. This remaining toner is removed by the blade 8. The erase lamp 9 removes electric charges remaining on the surface of the photosensitive belt 2.

After the process of returning the surface of the photosensitive belt 2 to initial conditions is finished, a toner image with a magenta color that is a subsequent color is similarly formed on the photosensitive belt 2. The magenta toner image is transferred with superposing the magenta toner image on the above-described yellow toner image held on the surface of the intermediate transfer roller 3, and is held on the intermediate transfer roller 3. In similar processes, cyan and black toner images are also superposed on the intermediate transfer roller 3 into a four-colored toner image, and are held on the surface of the intermediate transfer roller 3 simultaneously.

In order to transfer the four-colored toner image, formed on the surface of the intermediate transfer roller 3 in this manner, on the paper 16, the paper feeding roller 11 is rotated, one sheet of the paper 16 contained in the cassette 10 is drawn to be fed to the resist roller 12, and the skew of the paper is corrected and thereafter the feeding of the paper is stopped.

Next, in the timing of matching with the toner image on the intermediate transfer roller 3, the resist roller 12 is rotated. In the timing when an edge of the paper being fed comes into contact with the intermediate transfer roller 3, the transfer roller 13 is pressed to a back face of the paper 16, the toner image on the surface of the intermediate transfer roller 3 is electrostatically transferred on the paper 16.

The paper 16 on which the toner image is transferred from the intermediate transfer roller 3 is passed between a heating roller and a pressure roller of the fixing device 14, the toner image is fixed on the paper 16, and the paper 16 is guided by the paper eject guide 17 and is stacked in an upper portion of the apparatus 1.

At this time, in order to prevent air heated in the fixing device 14 from staying in the upper portion of the fixing device 14, the air is exhausted outside the-apparatus by the exhaust fan 18.

Figure 2:
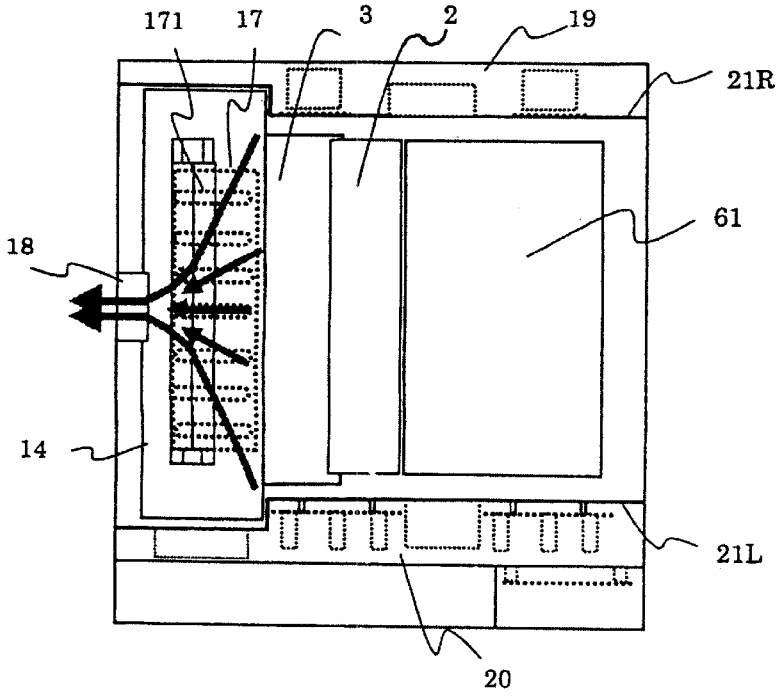
FIG. 2 PRIOR ART
FIG. 2 is a top view of the general color electrophotographic apparatus.

Referring to FIG. 2, the exhaust fan 18 is provided at the center of the fixing device 14 in a width direction. By the rotation of the exhaust fan 18, the air in the upper portion of the fixing device 14 passes a vent hole 171 provided in the paper eject guide 17, and is sucked by the exhaust fan 18 to be exhausted outside the apparatus as shown by an arrow. Numeral 19 denotes a drive unit. Numeral 20 denotes a power supply unit. Numeral 21L denotes a left body frame, and 2IR denotes a right body frame.

Figure 3:
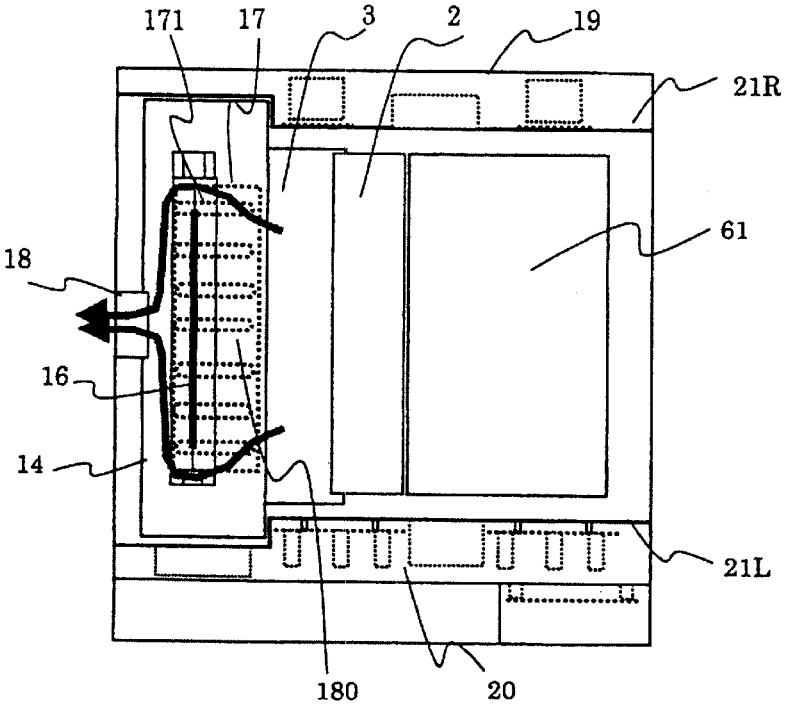
FIG. 3 PRIOR ART
FIG. 3 is a top view of the general color electrophotographic apparatus.

In such a color electrophotographic apparatus, an air exhaust state during a paper is ejected is shown in FIG. 3.

Referring to FIG. 3, when the paper 16 is being ejected from the fixing device 14, airflow in the upper portion of the fixing device 14 collides with the paper 16 and then detours toward both ends of the paper 16, and goes toward the exhaust fan 18. owing to this, air in an area 180 opposite to the exhaust fan 18 with respect to the paper 16 stays, and the temperature gradually rises at the time of paper ejection.

By the way, toner just after ejected from the fixing device 14 is such a semisolid state that the toner is not completely hardened, and usually becomes cold and solid by the paper 16 passes the paper eject guide 17-and is stacked in the upper portion of the body 1.

However, as described above, if environmental temperature in the upper portion of the fixing device 14 and the paper eject guide 17 is high, the paper that is ejected from the fixing device 14 and has the toner that is semisolid is ejected outside the apparatus, and is stacked in the upper portion of the apparatus 1. Therefore, there arise such problems that stacked paper is hard to radiate heat and hence paper previously stacked adheres to the toner that is melted. In addition, it is also difficult in the fixing section, which became high temperature, to perform maintenance such as jam release.

Furthermore, there is such a possibility that, if the temperature of the upper portion of the fixing device 14 progressively rises and the temperature in the apparatus also rises, toner in the development devices 61, 62, 63, and 64, and waste toner or the like which do not contribute to an image melt. In such a state, there arise problems such as filming, which toner deposits on a developing roller, and lock of a drive motor due to the increase of toner transfer load.

Hence, in order to solve these problems and to perform miniaturization and high speed, it is essential to prevent temperature rise by exhausting the heat in the upper portion of the fixing device 14 even if the paper 16 is sandwiched by the fixing device 14.

Figure 4:
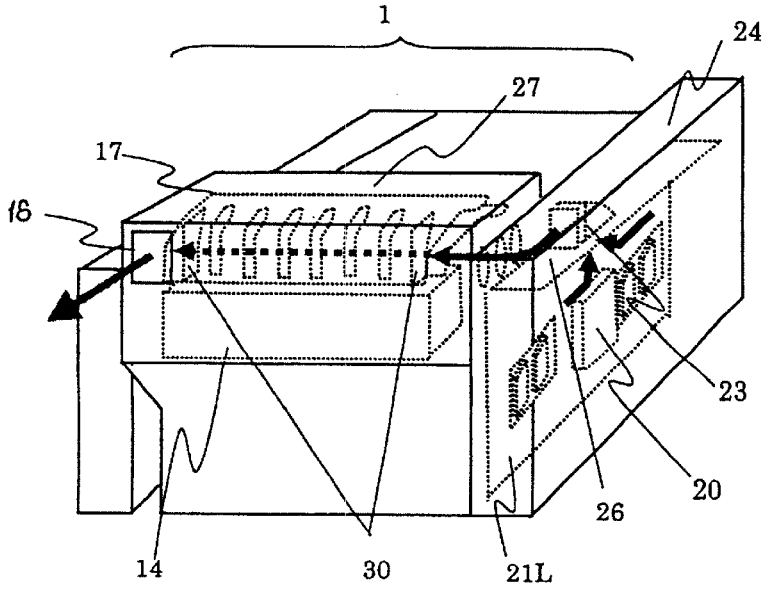
FIG. 4 s a perspective view of a color electrophotographic apparatus according to the present invention.

FIG. 4 is a perspective view of a color electrophotographic apparatus according to the present invention, viewed from the back side of the apparatus.

Referring to FIG. 4, the exhaust fan 18 is provided in an area that is a non-paper-passing area and a side end in a width direction of the fixing device 14, and above the back face of the fixing device 14. In addition, at another side end of the fixing device 14, a second fan 23 for exhausting air in the vicinity of the power supply unit 20 is provided in the left body frame 21L in an upper portion of the power supply unit 20. Numeral 24 denotes an armor cover of the power unit, and contains therein the power supply unit 20 and power supply fan 23. Numeral 26 denotes a second flow path communicating from the second fan 23 to the eject paper cover 27. Numeral 30 denotes a guide.

Figure 5:
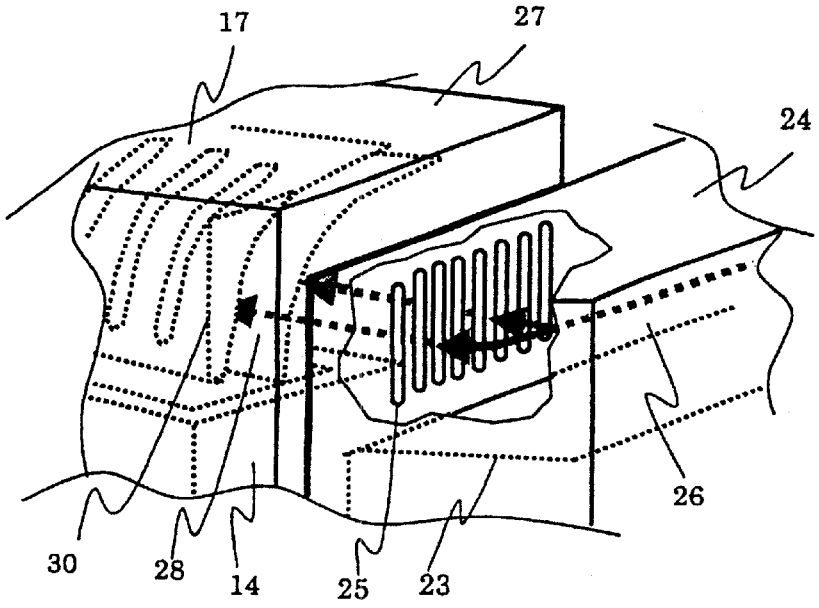
FIG. 5 is a partially perspective view of the color electrophotographic apparatus according to the present invention.

FIG. 5 is a partially perspective view of the apparatus according to the present invention.

Referring to FIG. 5, hot air around the power supply unit 20 is sucked by the second fan 23, and is made to flow toward the side end of the fixing device 14 through the flow path 26 formed by the power unit armor cover 24 and the left body frame 21L. Numeral 25 denote slits provided in the side end of the fixing device 14. The slits 25 become an inlet for introducing airflow from the second fan 23 into the fixing device 14.

Figure 6:
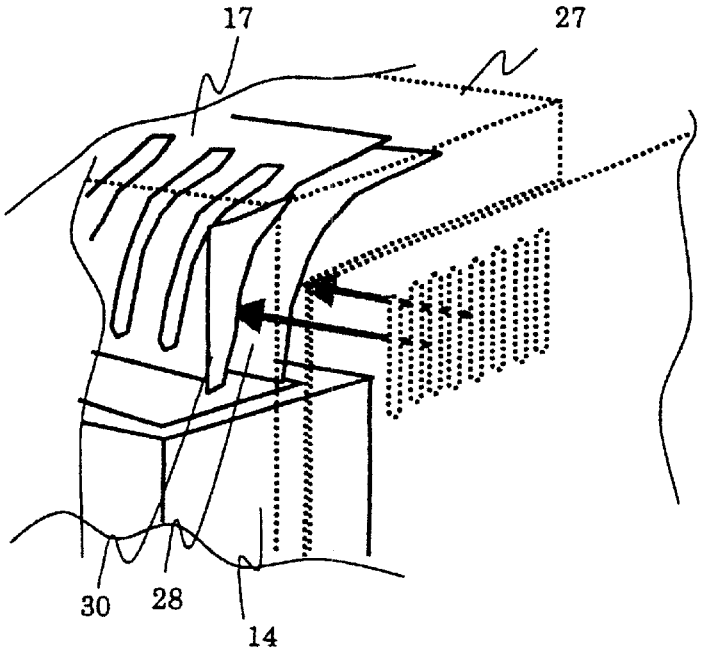
FIG. 6 is a partially perspective view of the color electrophotographic apparatus according to the present invention.

Referring to FIG. 6, the flow path 28 is formed with a drive unit armor cover 29 described later, the eject paper cover 27, and fixing device 14, and the guides 30 are provided in both longitudinal ends of the fixing device 14 in a back face of the paper eject guide 17. As a result, airflow surely passes the upper surface of the fixing device 14 in an axial direction. owing to this, since the exhaust fan 18 sucks air, which is exhausted from the second fan 23 and is pushed out to the upper portion of the fixing device 14, along the flow path 28, airflow is effectively formed.

Figure 7:
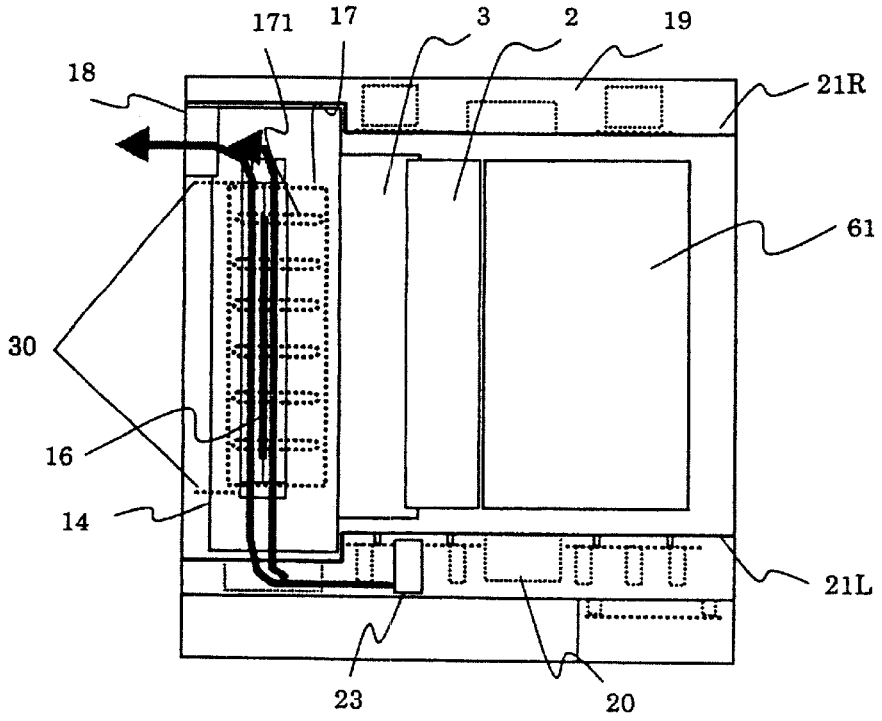
FIG. 7 is a top view of the color electrophotographic apparatus according to the present invention.

In particular, as shown in FIG. 7, even when the paper 16 is sandwiched by the fixing device 14, air flows in parallel to the paper 16 and therefore, it is possible to exhaust the heat in the upper portion of the fixing device 14 outside the apparatus surely and stably.

Figure 8:
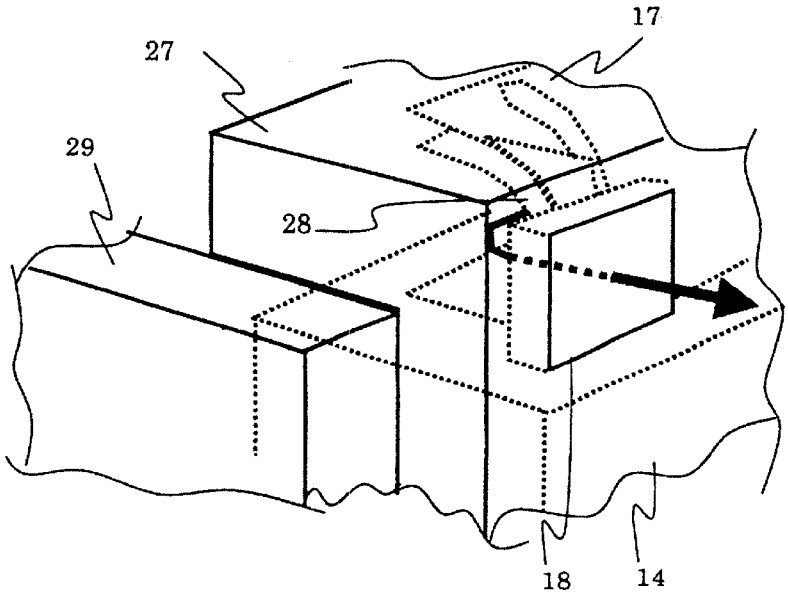
FIG. 8 is a partially perspective view of the color electrophotographic apparatus according to the present invention.

On the other hand, as shown in FIG. 8, regarding the exhaust fan 18, the flow path 28 is formed so as to suck air only from the longitudinal direction of the fixing device 14. The air sucked by the exhaust fan 14 is exhausted from the back face outside the apparatus.

Figure 9:
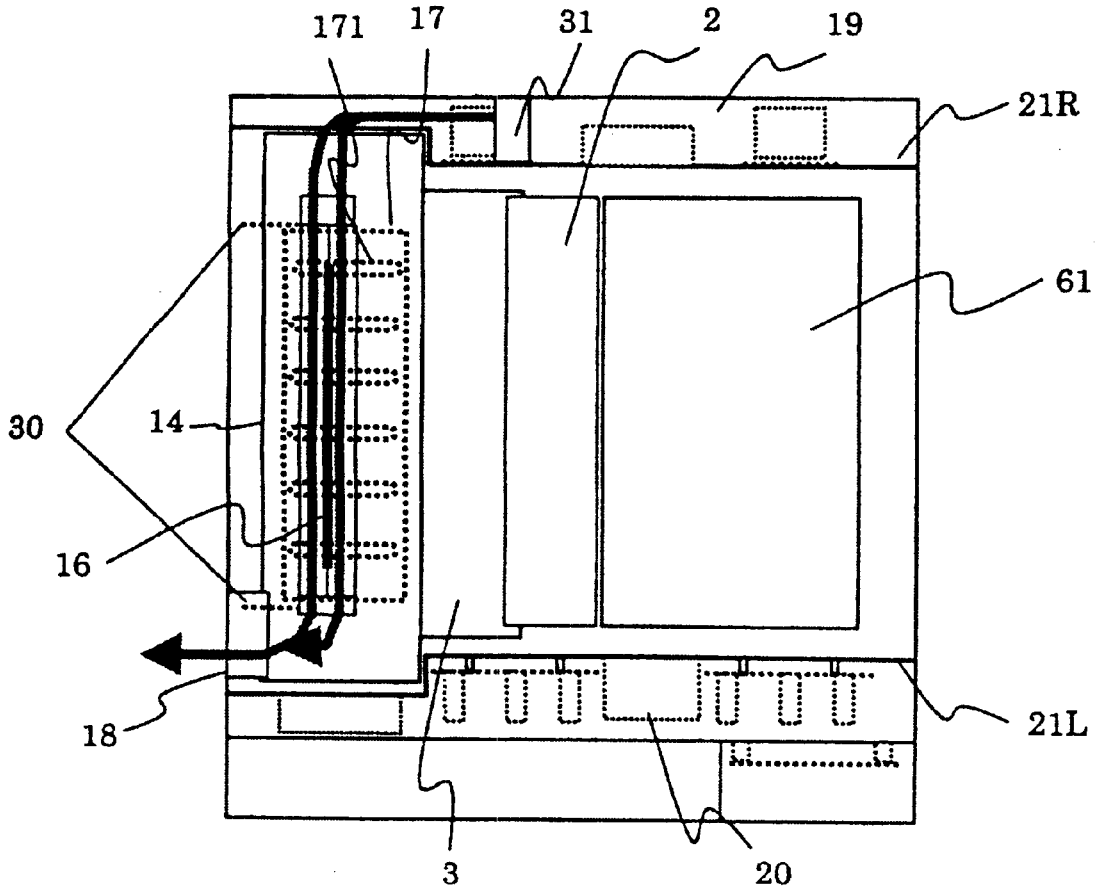
FIG. 9 is a top view of another color electrophotographic apparatus according to the present invention.

In addition, as shown in FIG. 9, it is also possible to obtain similar effects in such configuration that a fan 31 is provided in a side of a drive unit and a drive circuit.

As described above, first, the air exhausted by the second exhaust fan passes the flow path formed by the armor cover of the apparatus and the side frame panel, and-is made to flow from one side end of the fixing device in the axial direction of the upper portion of the fixing device. The air that is exhausted by the second exhaust fan and flows through the upper portion of the fixing device is sucked by the first exhaust fan, and is exhausted from a back face to the outside of the apparatus in another longitudinal end of the fixing device.

Therefore, since airflow is formed in stable flow velocity in the axial direction of the upper portion of the fixing device and is exhausted outside the apparatus, it becomes possible to stably exhaust the heat staying in the upper portion of the fixing device outside the apparatus. In consequence, temperature in the upper portion of the fixing device is lowered, problems such as the adhesion of a sheet of paper and another sheet of paper which are ejected, temperature rise in the apparatus, and maintainability such as jam release in the fixing section are solved, and hence a small and high-speed color electrophotographic apparatus can be realized.

What is claimed is:

1. An electrophotographic apparatus comprising:

a housing;

a photosensitive member electrified by an electrification device;

an exposure device for forming an electrostatic latent image onto the photosensitive member;

a developing device for forming a toner image onto the photosensitive member;

an intermediate transfer body to which the toner image is to be transferred;

a transfer device for transferring the toner image formed on the intermediate transfer body onto a paper;

a fixing device for heating the toner image on the paper;

means for ejecting the paper outside the housing;

means for exhausting the heat derived from the fixing device outside the housing;

a cover provided on an upper portion of the fixing device; and an airflow path extending in a longitudinal direction of the fixing device and being provided by the cover and the housing, wherein said heat exhausting means is provided in an end portion of said airflow path.

2. An electrophotographic apparatus comprising:

a housing;

a photosensitive member electrified by an electrification device;

an exposure device for forming an electrostatic latent image onto the photosensitive member;

a developing device for forming a toner image onto the photosensitive member;

an intermediate transfer body to which the toner image is to be transferred;

a transfer device for transferring the toner image formed on the intermediate transfer body onto a paper;

a fixing device for heating the toner image on the paper;

means for ejecting the paper outside the housing;

means for exhausting the heat derived from the fixing device outside the housing;

a cover provided on an upper portion of the fixing device; and an airflow path extending in a longitudinal direction of the fixing device and being provided by the cover and the housing, wherein said heat exhausting means is provided in an end portion of said airflow path;

wherein a second heat exhausting means is provided in an airflow path going to said fixing device from driving means and a drive circuit in said housing.

3. An electrophotographic apparatus comprising:

a housing;

a photosensitive member electrified by an electrification device;

an exposure device for forming an electrostatic latent image onto the photosensitive member;

a developing device for forming a toner image onto the photosensitive member;

an intermediate transfer body to which the toner image is to be transferred;

a transfer device for transferring the toner image formed on the intermediate transfer body onto a paper;

a fixing device for heating the toner image on the paper;

means for ejecting the paper outside the housing;

means for exhausting the heat derived from the fixing device outside the housing;

a cover provided on an upper portion of the fixing device; and an airflow path extending in a longitudinal direction of the fixing device and being provided by the cover and the housing, wherein said heat exhausting means is provided in an end portion of said airflow path;

wherein a second heat exhausting means is provided in an upper portion of a power supply unit in the housing.

4. An electrophotographic apparatus comprising:

a housing;

a photosensitive member electrified by an electrification device;

an exposure device for forming an electrostatic latent image onto the photosensitive member;

a developing device for forming a toner image onto the photosensitive member;

an intermediate transfer body to which the toner image is to be transferred;

a transfer device for transferring the toner image formed on the intermediate transfer body onto a paper;

a fixing device for heating the toner image on the paper;

means for ejecting the paper outside the housing;

means for exhausting the heat derived from the fixing device outside the housing;

a cover provided on an upper portion of the fixing device; and an airflow path extending in a longitudinal direction of the fixing device and being provided by the cover and the housing, wherein said heat exhausting means is provided in an end portion of said airflow path;

wherein a second heat exhausting means is provided in an upper portion of driving means and a driving circuit in said housing.

5. An electrophotographic apparatus comprising:

a housing;

a photosensitive member electrified by an electrification device;

an exposure device forming an electrostatic latent image on the photosensitive member;

a developing device for forming a toner image onto the photosensitive member;

an intermediate transfer body to which the toner image is to be transferred;

a transfer device for transferring the toner image formed on the intermediate transfer body on a paper;

a fixing device for heating the toner image on the paper;

means for ejecting the paper outside the housing;

a cover provided at an upper portion of the fixing device;

an airflow path extending in a longitudinal direction of the fixing device and being provided by the cover and the housing;

first air exhausting means provided in an end portion of the airflow path; and second air exhausting means provided in an upstream side, in an air flow, of said first air exhausting means.

6. An electrophotographic apparatus according to claim 5, wherein said second air exhausting means is provided in an airflow path going to said fixing device from driving means and a drive circuit in said housing.

7. An electrophotographic apparatus according to claim 5, wherein said second air exhausting means is provided in an upper portion of a power supply unit in the housing.

8. An electrophotographic apparatus according to claim 5, wherein said second air exhausting means is provided in an upper portion of driving means and a driving circuit in said housing.

9. An electrophotographic apparatus according to claim 1, wherein said heat exhausting means is disposed adjacent an end of said fixing device in the longitudinal direction thereof.

* * * * *